US006485262B1

(12) United States Patent
Heyward et al.

(10) Patent No.: US 6,485,262 B1
(45) Date of Patent: Nov. 26, 2002

(54) METHODS AND APPARATUS FOR EXTENDING GAS TURBINE ENGINE AIRFOILS USEFUL LIFE

(75) Inventors: John Peter Heyward, Loveland, OH (US); Roger Dale Wustman, Mason, OH (US); Timothy Lane Norris, Hamilton, OH (US); Richard Clay Haubert, Hamilton, OH (US); Paul John Fink, Maineville, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/900,326

(22) Filed: Jul. 6, 2001

(51) Int. Cl.[7] ..... F01D 5/18
(52) U.S. Cl. ..... 416/97 R; 416/241 R
(58) Field of Search ..... 415/115; 416/97 R, 416/97 A, 241 R

(56) References Cited

U.S. PATENT DOCUMENTS 3,695,778 A 10/1972 Taylor
4,031,274 A * 6/1977 Bessen ..... 427/229
4,132,816 A * 1/1979 Benden et al. ..... 427/237
4,236,870 A 12/1980 Hucul, Jr. et al.
4,302,153 A 11/1981 Tubbs
4,347,267 A * 8/1982 Baldi ..... 427/237
5,221,354 A 6/1993 Rigney
5,366,765 A * 11/1994 Milaniak et al. ..... 427/229
5,368,888 A 11/1994 Rigney
5,536,143 A 7/1996 Jacala et al.
5,824,366 A * 10/1998 Bose et al. ..... 427/239
6,299,935 B1 * 10/2001 Park et al. ..... 427/181

* cited by examiner

*Primary Examiner*—Edward K. Look
*Assistant Examiner*—Ninh Nguyen
(74) *Attorney, Agent, or Firm*—William Scott Andes; Armstrong Teasdale LLP

(57) ABSTRACT

A gas turbine engine includes a blade including a leading edge, a trailing edge, a first sidewall extending in radial span between a blade root and blade tip, and a second sidewall connected to the first sidewall at the leading edge and at the trailing edge. The first and second sidewalls each include an outer surface and an inner surface. A cooling cavity is defined by the first sidewall inner surface and the second sidewall inner surface. At least a portion of the cooling cavity is coated with an oxidation resistant environmental coating that has a thickness less than 0.0015 inches.

18 Claims, 3 Drawing Sheets

METHODS AND APPARATUS FOR EXTENDING GAS TURBINE ENGINE AIRFOILS USEFUL LIFE

BACKGROUND OF THE INVENTION

This invention relates generally to gas turbine engines, and more specifically to turbine blades used with gas turbine engines.

At least some known gas turbine engines include a core engine having, in serial flow arrangement, a high pressure compressor which compresses airflow entering the engine, a combustor which burns a mixture of fuel and air, and a turbine which includes a plurality of rotor blades that extract rotational energy from airflow exiting the combustor the burned mixture. Because the turbine is subjected to high temperature airflow exiting the combustor, turbine components are cooled to reduce thermal stresses that may be induced by the high temperature airflow.

The rotating blades include hollow airfoils that are supplied cooling air through cooling circuits. The airfoils include a cooling cavity bounded by sidewalls that define the cooling cavity. Cooling of engine components, such as components of the high pressure turbine, is necessary due to thermal stress limitations of materials used in construction of such components. Typically, cooling air is extracted air from an outlet of the compressor and the cooling air is used to cool, for example, turbine airfoils. The cooling air, after cooling the turbine airfoils, re-enters the gas path downstream of the combustor.

At least some known turbine airfoils include cooling circuits which channel cooling air flows for cooling the airfoil. More particularly, internal cavities within the airfoil define flow paths for directing the cooling air. Such cavities may define, for example, a serpentine shaped path having multiple passes. Cooling air is directed through a root portion of the airfoil into the serpentine shaped path. Because thermal stresses may be induced into the internal cavities, walls defining the cavities may be coated with a environmental coating to facilitate preventing oxidation within the cooling cavity.

To facilitate withstanding internal thermal stresses, at least some known blades are coated with a layer of environmental coating that has a thickness approximately equal to 0.003 inches. Applying the environmental coating with such a thickness prevents oxidation of the cavity walls and facilitates the airfoil withstanding thermal and mechanical stresses that may be induced within the higher operating temperature areas of the blade. However, the presence of an environmental coating at such a thickness may cause a reduction in material properties in regions of the blade operating at a lower temperature, which may lead to cracking of the material. In time, continued operation may lead to cracking of the blade and/or a premature failure of the blade within the engine.

BRIEF SUMMARY OF THE INVENTION

In one aspect of the invention, a blade for a gas turbine engine is provided. The blade includes a leading edge, a trailing edge, a first sidewall extending in radial span between a blade root and a blade tip, and a second sidewall connected to the first sidewall at the leading edge and at the trailing edge. The first and second sidewalls each include an outer surface and an inner surface. A cooling cavity is defined by the first sidewall inner surface and the second sidewall inner surface. At least a portion of the cooling cavity is coated with an oxidation resistant environmental coating that has a thickness less than 0.0015 inches.

In another aspect, a gas turbine engine including a plurality of blades including an airfoil is provided. Each airfoil includes a leading edge, a trailing edge, a wall, and a cooling cavity defined by the wall. The cooling cavity includes at least two chambers. A first of the chambers is bounded by the airfoil leading edge, and a second of the chambers is bounded by the airfoil trailing edge. A first portion of the cooling cavity is coated with an oxidation resistant environmental coating applied with a first thickness. A second portion of the cooling cavity is coated with an oxidation resistant environmental coating applied with a second thickness that is less than the first portion first thickness. More specifically, the second portion second thickness is less than 0.0015 inches.

In a further aspect, a method for manufacturing a blade for a gas turbine engine is provided. The method includes the steps of defining a cavity in the blade with a wall including a concave portion and a convex portion connected at a leading edge and at a trailing edge, and dividing the cavity into at least a leading edge chamber and a trailing edge chamber, such that the leading edge chamber is bordered by the blade leading edge, and the trailing edge chamber is bordered by the trailing edge. The method also includes the step of coating at least a portion of an inner surface of the wall with a layer of an oxidation resistant environmental coating having a thickness less than 0.0015 inches.

DETAILED DESCRIPTION OF THE INVENTION

Figure 1:
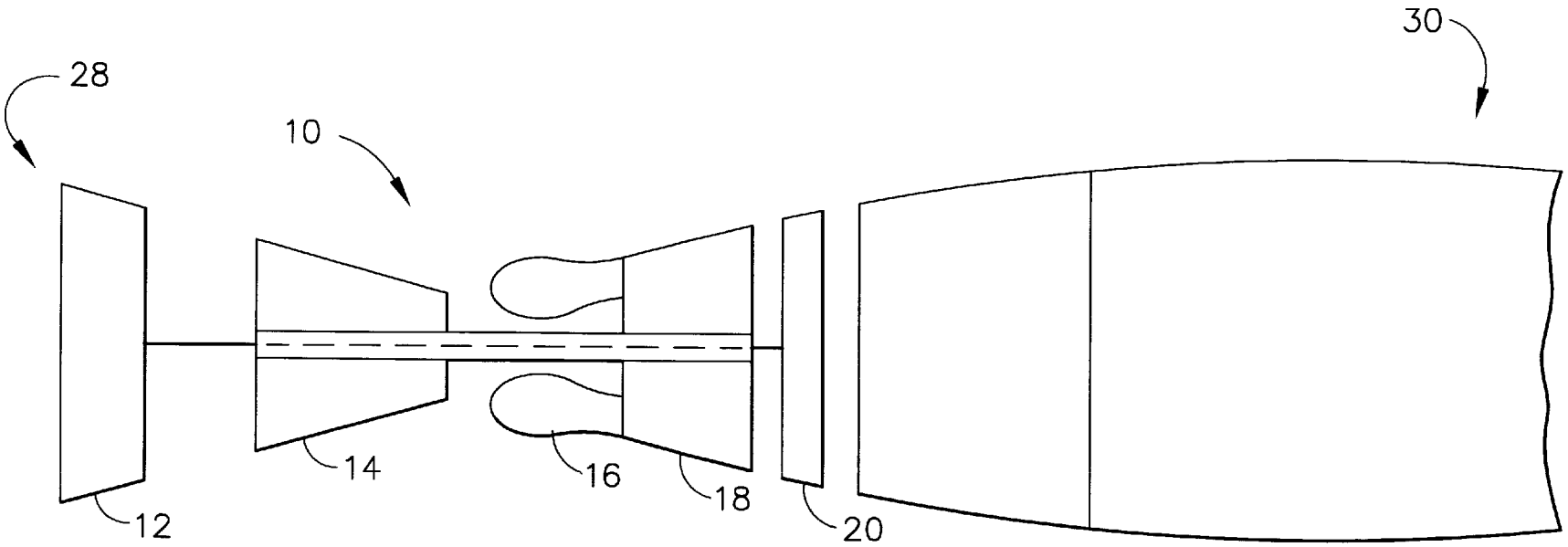
FIG. 1 is schematic illustration of a gas turbine engine.

FIG. 1 is a schematic illustration of a gas turbine engine 10 including a fan assembly 12, a high pressure compressor 14, and a combustor 16. Engine 10 also includes a high pressure turbine 18 and a low pressure turbine 20. Engine 10 has an intake side 28 and an exhaust side 30. In one embodiment, engine 10 is a CFM-56 engine commercially available from CFM International, Cincinnati, Ohio.

In operation, air flows through fan assembly 12 and compressed air is supplied to high pressure compressor 14. The highly compressed air is delivered to combustor 16. Airflow from combustor 16 drives turbines 18 and 20, and turbine 20 drives fan assembly 12. Turbine 18 drives high pressure compressor 14.

Figure 2:
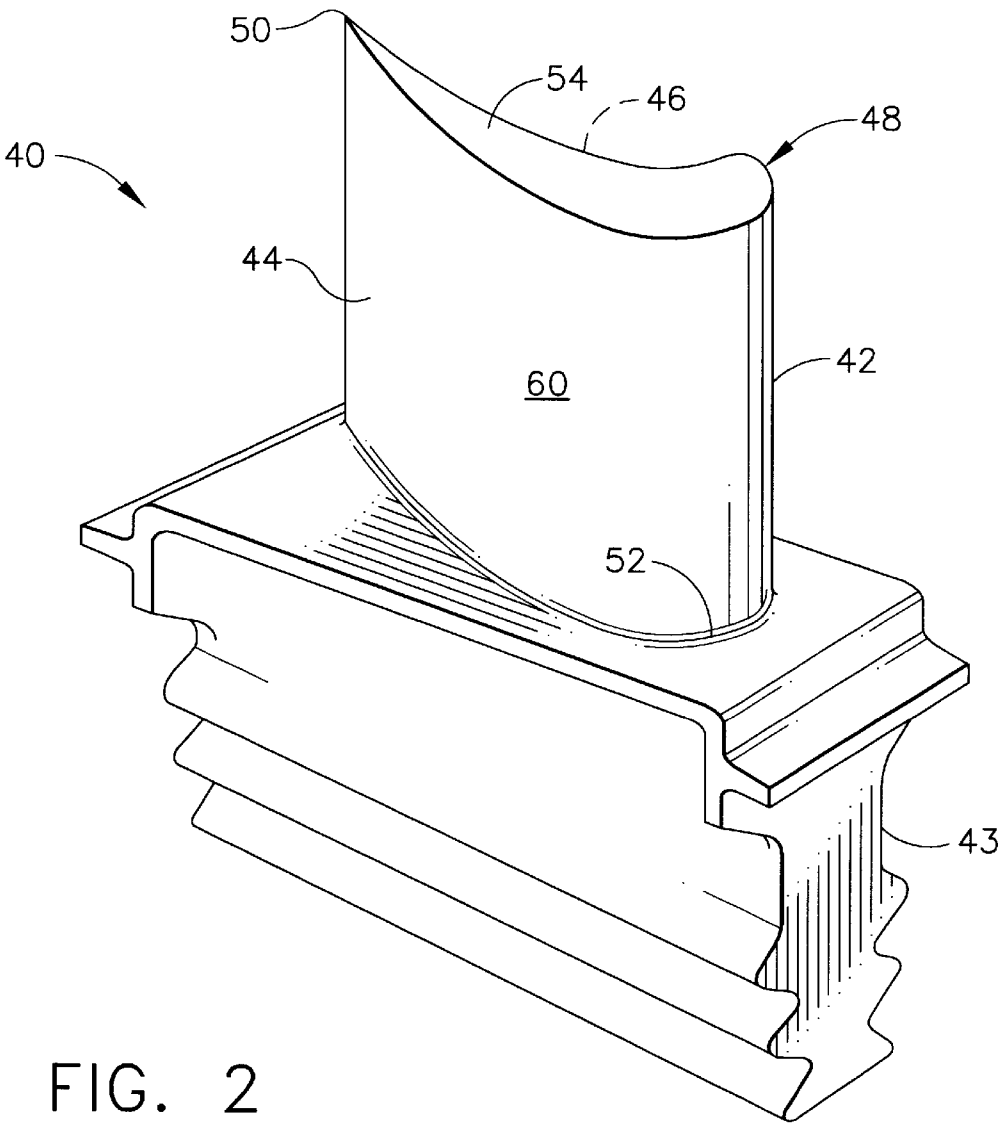
FIG. 2 is a perspective view of a turbine blade that may be used with the gas turbine engine shown in FIG. 1.

FIG. 2 is a perspective view of a turbine blade 40 that may be used with a gas turbine engine, such as gas turbine engine 10 (shown in FIG. 1). In one embodiment, a plurality of turbine blades 40 form a high pressure turbine rotor blade stage (not shown) of gas turbine engine 10. Each blade 40 includes a hollow airfoil 42 and an integral dovetail 43 that is used for mounting airfoil 42 to a rotor disk (not shown) in a known manner. Alternatively, blades 40 may extend radially outwardly from a disk (not shown), such that a plurality of blades 40 form a blisk (not shown).

Each airfoil 42 includes a first sidewall 44 and a second sidewall 46. First sidewall 44 is convex and defines a suction side of airfoil 42, and second sidewall 46 is concave and defines a pressure side of airfoil 42. Sidewalls 44 and 46 are joined at a leading edge 48 and at an axially-spaced trailing edge 50 of airfoil 42. More specifically, airfoil trailing edge 50 is spaced chordwise and downstream from airfoil leading edge 48.

First and second sidewalls 44 and 46, respectively, extend longitudinally or radially outward in span from a blade root 52 positioned adjacent dovetail 43, to an airfoil tip 54. Airfoil tip 54 defines a radially outer boundary of an internal cooling chamber (not shown in FIG. 2). The cooling chamber is bounded within airfoil 42 between sidewalls 44 and 46. More specifically, airfoil 42 includes an inner surface (not shown in FIG. 2) and an outer surface 60, and the cooling chamber is defined by the airfoil inner surface. In one embodiment, airfoil first and second sidewalls 44 and 46, respectively, include a plurality of cooling openings (not shown) extending between the airfoil wall inner surface and airfoil outer surface 60.

Figure 3:
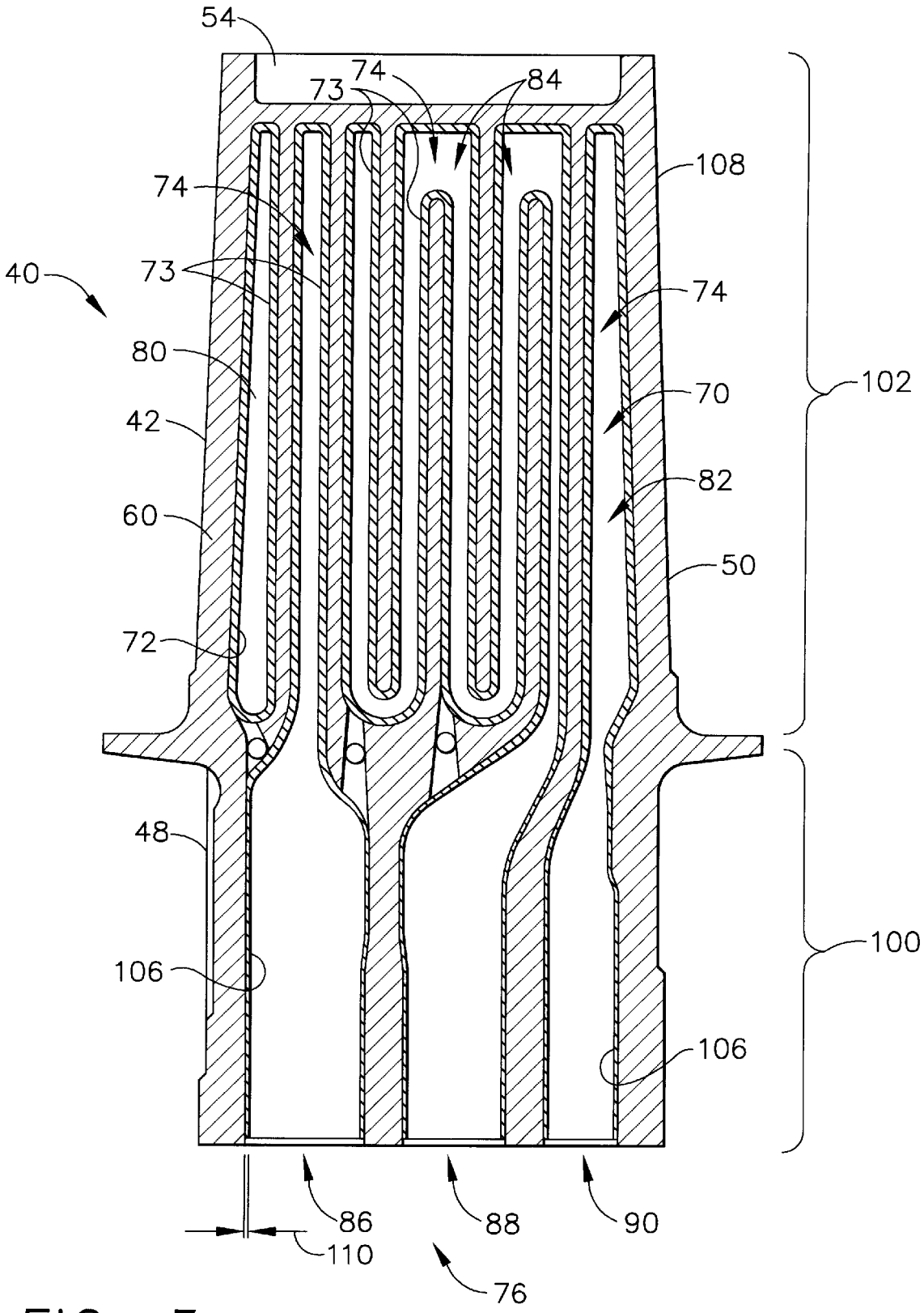
FIG. 3 is an exemplary cross sectional view of the blade shown in FIG. 2.

FIG. 3 is an exemplary cross-sectional view of blade 40 including airfoil 42. Blade 40 includes a cooling cavity 70 defined by an inner surface 72 of blade 40. Cooling cavity 70 includes a plurality of inner walls 73 which partition cooling cavity 70 into a plurality of cooling chambers 74. The geometry and interrelationship of chambers 74 to walls 73 varies with the intended use of blade 40. In one embodiment, inner walls 73 are cast integrally with airfoil 42. Cooling chambers 74 are supplied cooling air through a plurality of cooling circuits 76. More specifically, in the exemplary embodiment, airfoil 42 includes a forward cooling chamber 80, an aft cooling chamber 82, and a plurality of mid cooling chambers 84.

Forward cooling chamber 80 extends longitudinally or radially through airfoil 42 to airfoil tip 54, and is bordered by airfoil first and second sidewalls 44 and 46, respectively (shown in FIG. 2), and by airfoil leading edge 48. Forward cooling chamber 80 is cooled with cooling air supplied by a forward cooling circuit 86.

Mid cooling chambers 84 are between forward cooling chamber 80 and aft cooling chamber 82, and are supplied cooling air by a mid-circuit cooling circuit 88. More specifically, mid cooling chambers 84 are in flow communication and form a serpentine cooling passageway. Mid cooling chambers 84 are bordered by bordered by airfoil first and second sidewalls 44 and 46, respectively, and by airfoil tip 54.

Aft cooling chamber 82 extends longitudinally or radially through airfoil 42 to airfoil tip 54, and is bordered by airfoil first and second sidewalls 44 and 46, respectively, and by airfoil trailing edge 50. Aft cooling chamber 82 is cooled with cooling air supplied by an aft cooling circuit 90 which defines a radially outer boundary of cooling chamber 82. In one embodiment, airfoil 42 includes a plurality of trailing edge openings (not shown) that extend between airfoil outer surface 60 and airfoil inner surface 72.

Blade 40 also includes a root portion 100 and an airfoil body portion 102. Root portion 100 is bounded by airfoil root 52 (shown in FIG. 2) and extends through a portion of dovetail 43. Airfoil body portion 102 is in flow communication with blade root portion 100 and extends from root portion 100 to airfoil tip 54. In one embodiment, portions of chambers 74 extending through root portion 100 are known as root passages.

Airfoil inner surface 72 is coated with a layer 106 of an oxidation resistive environmental coating. In one embodiment, the oxidation resistive environmental coating is an aluminide coating commercially available from Howmet Thermatech, Whitehall, Mich. In the exemplary embodiment, an oxidation resistive environmental coating is applied to airfoil inner surface 72 by a vapor phase aluminide deposition process. More specifically, thickness 110 of oxidation resistive environmental coating is limited to less than 0.003 inches within airfoil body portion 102, and is limited to less than 0.0015 inches within blade root portion 100, which operates with a lower operating temperature in comparison to airfoil body portion 102. In a preferred embodiment, a thickness 110 of oxidation resistive environmental coating is limited to less than 0.001 inches within blade root portion 100.

During fabrication of cavity 70, a core (not shown) is cast into airfoil 42. The core is fabricated by injecting a liquid ceramic and graphite slurry into a core die (not shown). The slurry is heated to form a solid ceramic airfoil core. The airfoil core is suspended in an airfoil die (not shown) and hot wax is injected into the airfoil die to surround the ceramic airfoil core. The hot wax solidifies and forms an airfoil (not shown) with the ceramic core suspended in the airfoil.

The wax airfoil with the ceramic core is then dipped in a ceramic slurry and allowed to dry. This procedure is repeated several times such that a shell is formed over the wax airfoil. The wax is then melted out of the shell leaving a mold with a core suspended inside, and into which molten metal is poured. After the metal has solidified the shell is broken away and the core removed.

During engine operation, cooling air is supplied into airfoil 42 through cooling circuits 76. In one embodiment, cooling air is supplied into airfoil 42 from a compressor, such as compressor 14 (shown in FIG. 1). Cooling air entering blade root portion 100 is channeled into airfoil cooling chambers 74 and airfoil body portion 102. Because hot combustion gases impinge upon airfoil body portion 102, an operating temperature of blade internal surface 72 may increase. More specifically, an operating temperature of airfoil body portion 102 may actually increase to a higher temperature than that of an associated operating temperature of blade root portion 100. The oxidation resistive environmental coating facilitates reducing oxidation of airfoil internal surface 72 despite the increased operating temperature.

Furthermore, during operation, stresses generated during engine operation may induced into blade root portion 100. Limiting a thickness 110 of the oxidation resistive environmental coating to less than 0.001 inches within blade root portion 100 facilitates preventing material degradation within blade root portion 100, thereby maintaining a fatigue life of blade 40. More specifically, limiting cracking of the oxidation resistive environmental coating within blade root portion 100 facilitates maintaining fatigue life within blade root portion 100 and, thus, extends a useful life of blade 40.

The above-described blade is cost-effective and highly reliable. The blade includes a layer of oxidation resistive environmental coating applied to the blade inner surface such that a layer thickness of the environmental coating is less than 0.0015 inches. The thinner layer thickness within the blade root portion facilitates less cracking of the environmental coating within the blade root portion, and thus, less fatigue life of the blade. As a result, the reduced thickness of the oxidation resistive environmental coating facilitates maintaining thermal fatigue life and extending a useful life of the airfoil in a cost-effective and reliable manner.

While the invention has been described in terms of various specific embodiments, those skilled in the art will recognize that the invention can be practiced with modification within the spirit and scope of the claims.

What is claimed is:

1. A method for manufacturing a blade for a gas turbine engine, said method comprising the steps of:

defining a cavity in the blade with a wall including a concave portion and a convex portion connected at a leading edge and at a trailing edge;

dividing the cavity into at least a leading edge chamber and a trailing edge chamber, such that the leading edge chamber is bordered by the blade leading edge, and the trailing edge chamber is bordered by the trailing edge;

coating at least a first portion of an inner surface of the wall with a layer of an oxidation resistant environmental coating having a first thickness; and coating at least a second portion of an inner surface of the wall with a layer of an oxidation resistant environmental coating having a second thickness that is less than said first thickness, said second portion second thickness less than 0.0015 inches.

2. A method in accordance with claim 1 wherein said step of coating at least a portion further comprises the step of coating at least a portion of the wall inner surface with a layer of oxidation resistant environmental coating having a thickness less than 0.001 inches.

3. A method in accordance with claim 1 further comprising the step of dividing the blade into a root portion and an airfoil body portion such that the root portion is in flow communication with the airfoil body portion and is bounded by a root of the blade, and such that the airfoil body portion is bounded by a tip of the blade.

4. A method in accordance with claim 3 wherein said step of coating at least a portion of an inner surface further comprises the step of coating the blade portion inner wall with a layer of oxidation resistant environmental coating having a thickness less than about 0.001 inches thick.

5. A method in accordance with claim 1 wherein said step of coating at least a portion further comprises the step of coating at least a portion of the blade wall inner surface with a layer of oxidation resistant environmental coating to facilitate maintaining fatigue life of the blade.

6. A blade for a gas turbine engine, said blade comprising:

a leading edge;

a trailing edge;

a first sidewall extending in radial span between a blade root and a blade tip, said first sidewall comprising an outer surface and an inner surface;

a second sidewall connected to said first sidewall at said leading edge and said trailing edge, said second sidewall comprising an outer surface and an inner surface; and a cooling cavity defined by said first sidewall inner surface and said second sidewall inner surface, at least a first portion of said cooling cavity coated with an oxidation resistant environmental coating having a first thickness and at least a second portion of said cooling cavity coated with an oxidation resistant environmental coating having a second thickness that is less than 0.0015 inches.

7. A blade in accordance with claim 6 further comprising an inner wall defining a plurality of chambers within said cooling cavity.

8. A blade in accordance with claim 7 wherein said plurality of chambers in flow communication, said cooling cavity further comprising a root portion and an airfoil portion, said root portion in flow communication with said airfoil portion.

9. A blade in accordance with claim 8 wherein said cooling cavity configured to facilitate reducing root portion cracking.

10. A blade in accordance with claim 8 wherein said root passage portion coated with oxidation resistant environmental coating having a thickness less than 0.001 inches.

11. A blade in accordance with claim 6 wherein at least a portion of said cooling cavity coated with an oxidation resistant environmental coating having a thickness less than 0.001 inches to facilitate maintaining fatigue life of said blade.

12. A gas turbine engine comprising a plurality of blades, each said blade comprising a cooling cavity and an airfoil, said airfoil comprising a leading edge, a trailing edge, and a wall, said cooling cavity defined by said wall, said cooling cavity comprising at least two chambers, a first of said chambers bounded by said leading edge, a second of said chambers bounded by said trailing edge, a first portion of said cooling cavity coated with an oxidation resistant environmental coating having a first thickness, a second portion of said cooling cavity coated with an oxidation resistant environmental coating having a second thickness that is less than said first portion first thickness, said second portion second thickness less than 0.0015 inches.

13. A gas turbine engine in accordance with claim 12 wherein said second portion thickness less than 0.001 inches.

14. A gas turbine engine in accordance with claim 12 wherein said cooling cavity coated with an oxidation resistant environmental coating having a thickness configured to maintain reducing fatigue life of each said blade.

15. A gas turbine engine in accordance with claim 12 wherein each said blade comprises a root and a tip, said wall extending from said root to said tip, said first portion bounded by said blade tip and said wall, said second portion bounded by said blade root and said wall.

16. A gas turbine engine in accordance with claim 15 wherein said each said blade first portion in flow communication with said blade second portion.

17. A gas turbine engine in accordance with claim 15 wherein said blade wall bordering said cooling cavity second portion coated with an oxidation resistant environmental coating having a thickness less than 0.001 inches.

18. A gas turbine engine in accordance with claim 12 wherein said blade second portion second thickness configured to facilitate reducing cracking within said blade second portion.

* * * * *